United States Patent [19]

Dantlgraber

[11] 4,443,159

[45] Apr. 17, 1984

[54] POWER CONTROL DEVICE FOR PUMPS

[75] Inventor: Jörg Dantlgraber, Lohr-Sackenbach, Fed. Rep. of Germany

[73] Assignee: Mannesmann-Rexroth GmbH, Lohr, Fed. Rep. of Germany

[21] Appl. No.: 249,665

[22] Filed: Mar. 26, 1981

[30] Foreign Application Priority Data

Sep. 11, 1980 [DE] Fed. Rep. of Germany ..... 3034115

[51] Int. Cl.[3] ..... F04B 49/00

[52] U.S. Cl. ..... 417/220; 60/452

[58] Field of Search ..... 417/218–222; 60/445, 452; 91/505, 506

[56] References Cited

U.S. PATENT DOCUMENTS

| | | | |
|---|---|---|---|
| 2,835,228 | 5/1958 | Parr et al. | 417/222 X |
| 4,035,105 | 7/1977 | Dantlgraber | 417/220 |
| 4,077,744 | 3/1978 | Pensa | 417/218 |

FOREIGN PATENT DOCUMENTS

| | | | |
|---|---|---|---|
| 2141722 | 3/1973 | Fed. Rep. of Germany | 417/220 |
| 3016609 | 11/1981 | Fed. Rep. of Germany | 417/220 |

*Primary Examiner*—Edward K. Look

*Attorney, Agent, or Firm*—Michael J. Striker

[57] ABSTRACT

A power output control device for a pump having a delivery adjuster, is formed of a housing including a control piston attacked at one end with the output medium of the pump and having means for controlling the pump adjuster; a two-armed rocking lever is supported in the housing for movement parallel to the axis of the control piston, one arm of the lever being biased by a governor spring having a progressive biasing force while the other arm of the lever acts on the control piston against the force of pressure medium; an additional biasing spring thrusts against the other arm of the lever and a first setting screw adjusts the biasing force of the additional biasing means and a second setting screw adjusts the biasing force of the governor spring by adjusting the position of the pivot point of the two-armed rocking lever.

5 Claims, 3 Drawing Figures

POWER CONTROL DEVICE FOR PUMPS

BACKGROUND OF THE INVENTION

The present invention relates in general to power control devices for pumps of the type having a delivery adjuster including an adjustment member, an adjustment spring acting on the adjustment member, a control piston exposed to pressure of the pumped medium and being biased by a governor spring exhibiting a progressive characteristic of its spring force. In a prior art power control device of the afore-described type to change the normally constant power output (product of the amount of the delivered medium and of pressure of the medium) of the adjustable pump the governor spring has to be changed. Such replacement however is usually a cumbersome operation.

SUMMARY OF THE INVENTION

It is therefore a general object of the present invention to overcome the aforementioned disadvantage.

More particularly, it is an object of the invention to provide a power output control device by means of which the power of the pump defined as a product of the amount of the delivered medium and of its pressure, can be arbitrarily adjusted in broad limits.

In keeping with these objects, and others which will become apparent hereafter, one feature of the invention resides in the provision of additional biasing means for acting against the control piston with a constant force, and means for adjusting the additional constant force of the biasing means. Due to the fact that the governor spring acts on the control piston with a progressive force, the adjustment of the constant product of the amount of the delivered medium and of its pressure is a function represented on a plot diagram by a hyperbola. In adjusting the bias of the governor spring such hyperbola is only shifted parallel to the axis designating the through flow of the pumped medium and consequently in the case of larger change of the bias a distinct variation from the original throughflow will occur. Accordingly, by a corresponding adjustment of the additional biasing force acting on the control piston the hyperbola is shifted parallel to the throughflow axis in the plot diagram and a good approximation of the desired hyperbolic characteristic line of the pump is achieved in which the product of the delivered or throughflowing medium and of its pressure has a higher or lower volume than before.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 1:
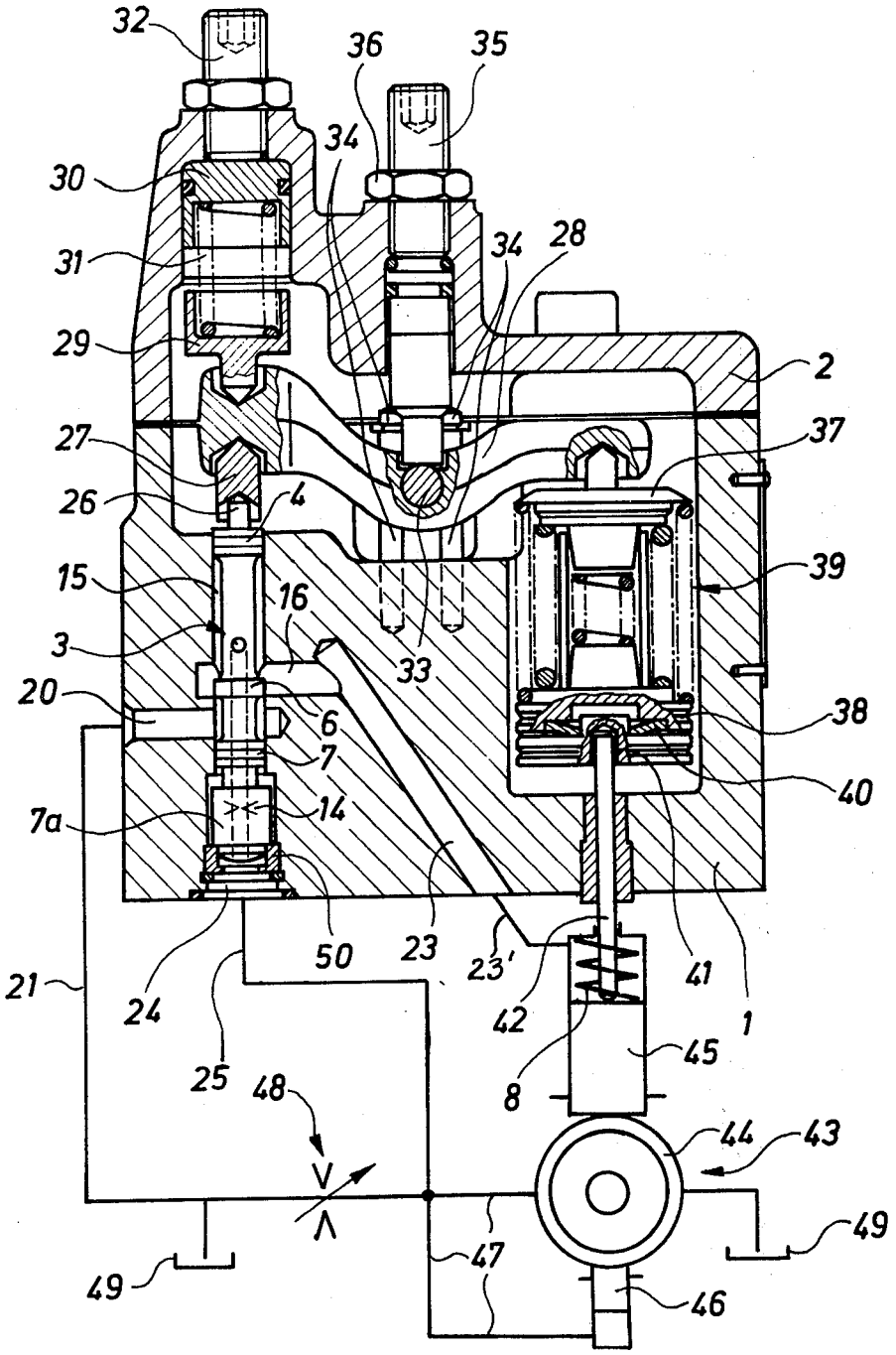
FIG. 1 is a sectional side view of an output control device for pumps according to this invention.
Figure 2:
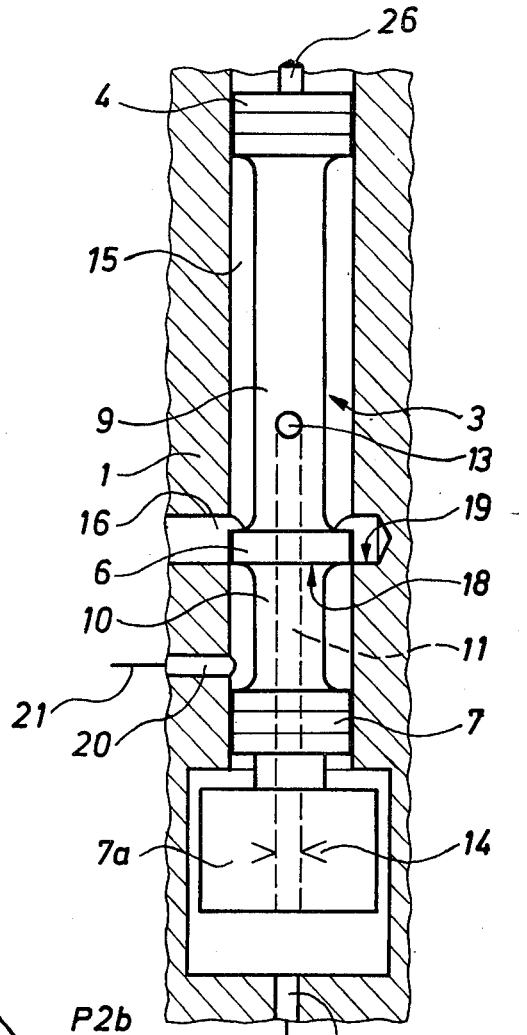
FIG. 2 is a sectional side view of a cutaway part of a device of FIG. 1 shown on an enlarged scale.

Referring to FIGS. 1 and 2, the output control device includes a housing 1 provided with a detachable housing cover 2. A control piston 3 illustrated on an enlarged scale in FIG. 2 is arranged for reciprocating axial movement in the housing 1. The control piston 3 is formed with three piston areas 4, 6 and 7 separated from each other by intermediate piston areas 5 and 10 of smaller diameter, and further includes at its lower end a piston area 7*a* of increased diameter acting as a stop collar in cooperation with a recessed shoulder in the housing 1. The end face of the piston area 7*a* is formed with an axial blind bore 11 having a radial outlet passage 13 opening into the intermediate section 9. In the range of the piston area 7*a* the blind bore is formed with throttling point 14 illustrated schematically in FIGS. 1 and 2. Housing 1 is formed with a channel 23 communicating via passage 16 with bore 4 accommodating the piston 3 and forms therewith a control edge. An other radial passage 20 is arranged immediately below the passage 16 and communicates with the bore for the piston 3 in the range of its intermediate section 10. Passage 20 is connected to a conduit 21 and the passage 16 is connected via the channel 23 to a conduit 23'. The lower part 24 of the bore 4 accommodating the large diameter piston area 7*a* is connected through a conduit 25.

The upper end face of piston 3 coinciding with the end face of piston 44 is provided with an upwardly directed pin 26 engaging a linking piece 27. The pointed end of linking piece 27 engages a conical recess in one arm of a two-arm rocking lever 28. At the opposite side of the one arm of lever 28 is formed a corresponding conical recess engaging a downwardly projecting pin formed on the bottom of a spring retainer 29 supporting one end of a helical spring 31. The other end of spring 31 rests in a cup-shaped spring retainer 30 inserted in a fitting recess in the housing cover 2 in such a manner as to be shiftable in axial direction. A setting screw 32 engages a threaded bore in the cover 2 opposite the center of the spring retainer 30 so that the axial position of the latter and thus the biasing force of spring 31 can be adjusted. The position of the setting screw 32 is secured by a locking nut.

The two-arm lever 28 is supported for rocking movement about pivot pins 33 projecting at both sides of the central area of the lever 28. The vertical position of the rocking lever 28 is adjusted by means four guiding pins 34 arranged in two opposite pairs and fixed to housing 1 in such a manner as to slidably engage both pivot pins 33 and the lever 28 and guide the same for displacement in a direction parallel to the axis of control piston 3 and of spring 31. Free ends of respective guiding pins 34 are provided with spring washers acting as stop members for the lever 28 and its pivot pins 33. The rocking lever 28 has an arched configuration defining a concave central portion bulging toward the housing 1. Another setting screw 35 is engageable in a threaded bore in the housing cover and is directed against this concave part of the lever and is coupled by slidable pieces to the upper surface of respective pivot pins 33. The axial position of the additional setting screw 35 is locked by means of a locking nut 36. The gap between the housing cover and the other setting screw 35 is sealed by a sealing ring.

The other arm of lever 28 remote from the control piston 3 is acted upon by a set 39 of helical springs arranged coaxially between two spring plates 37 and 38 of which the upper spring plate 37 is provided with a pointed coupling pin to engage a corresponding conical recess in the other arm of lever 28. The lower spring plate 38 rests on a cup spring 40 which is connected via a spring plate 51 to a transmission rod 42 slidably passing through the housing 1 and projecting outwardly. The set 39 of the three helical springs in combination with the cup spring 40 form together governor spring means exhibiting a progressive force corresponding approximately to a hyperbolic function. The governor spring means act against the control piston 3 in the same direction as spring 31.

Pump controlled by the device of this invention is a vane pump having an adjustment ring 44 acted upon at one point by a larger adjustment piston 45 and at the opposite point by a smaller adjustment piston 46. A projecting portion of rod 42 engages the larger adjustment piston 45 so as to press the same against the adjustment ring 44. The end face of piston 45 remote from the ring 44 is in addition biased by a relatively small force of a setting spring 8 and in addition by control pressure medium from conduit 23'. The smaller adjustment piston 46 has its end face (remote from the ring 44) attacked by pressure fluid from conduit 47 connected to the high pressure side of the pump 43 and thus it acts on the adjustment ring 44 proportionally to the momentary output pressure. The conduit 25 leading to the end face of the control piston 3 is also connected to the high pressure side of the vane pump 43 and conduit 37 is connected to a consumer 48 illustrated in the form of an adjustable throttle. Conduit 21 leading from the radial passage 20 is connected to a tank 49 and so is the return conduit from the consumer 48. An annular stop member 50 is inserted in the bore 24 to limit movement of control piston 3 in the housing 1.

Figure 3:
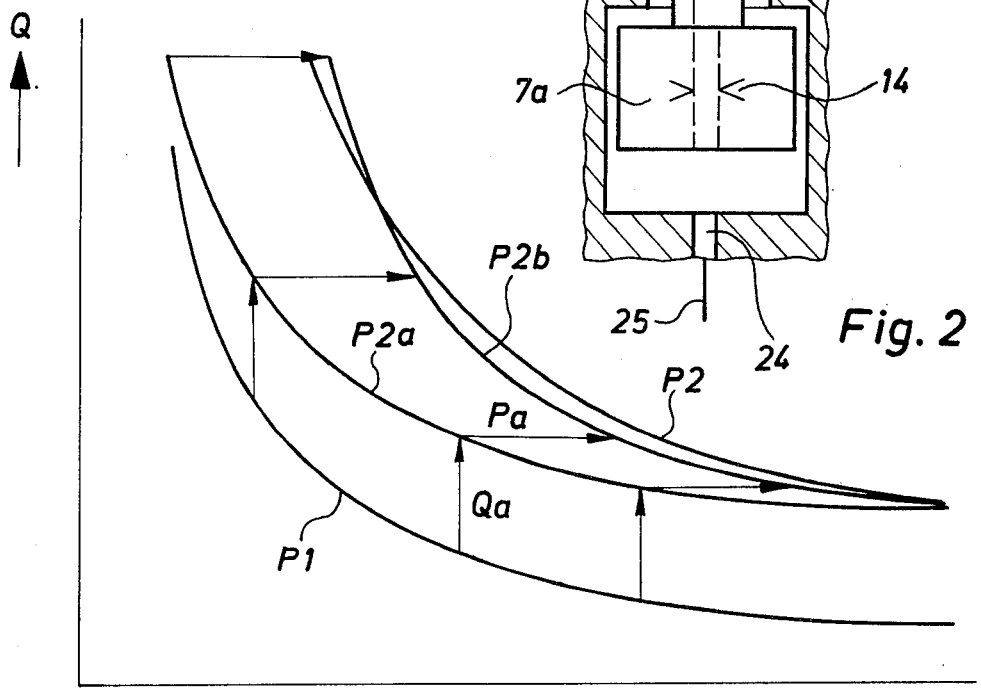
FIG. 3 is a plot diagram of the delivered flow (Q) versus pressure (P).

Referring now to the plot diagram in FIG. 3, the abscissa represents the applied pressure P and the ordinate represents the delivery flow Q. In the adjustable vane pump 43 the characteristic line representing the output amount of the delivered medium over the entire range of fluid pressures P, in other words the product of pressure and of the delivered flow or the power output, is constant and is in the form of a hyperbola P1. The hyperbola P2 is the function of pressure and delivered flow pertaining to another, large power output. The curve P2A results from the axial displacement of the curve P1 along the ordinate section $Q_a$ and the curve P2B results from the displacement of the curve P2A along the abscissa section PA. It is evident that the curve P2B considerably approximates the theoretical curve P2.

In the position of the control piston 3 as illustrated in FIG. 2, the connection between control space 15 and passage 16 to the tank 49 is interrupted. Consequently, the two adjustment pistons 45 and 46 of the pump 43 are attacked by pressure medium from high pressure conduits 47 and 25 whereby thrust exerted by the larger adjustment piston 45 exceeds the thrust exerted by the smaller adjustment piston 46. As a result, adjustment ring 44 is displaced in the direction corresponding to the maximum delivery flow Q of the pump 43. When the output pressure fluid displaces the control piston 3 against the force of springs 31 and 39, control edge 18 of the piston area 6 is raised above control edge 19 in the annular passage 16 thus establishing connection between passage 13 at the end of blind bore 11 and the lower passage 20 connected via conduit 21 to the tank 49. As a consequence control pressure in space 15 delimited by the intermediate piston region 9, is relieved and so decreases pressure acting on the larger adjustment piston 45 of the pump.

As soon as the pressure acting on the large adjustment piston 45 drops to a level at which the thrust exerted by the piston 45 on the adjustment ring 44 is lower than force exerted against the ring 44 by the smaller adjustment piston 46, the adjustment ring 44 is displaced in the direction of a smaller output flow in conduit 47 until the output pressure of the pump corresponds again to the combined forces of the set of springs 39, the cap spring 40 and of the spring 31.

If it is desired to adjust the vane pump 33 to another power output (e.g. constant product of pressure P and delivered flow Q), the adjustment is affected by means of the two setting screws 35 and 32. In turning the setting screw 35 in the direction of housing 1, P1 can be shifted about the value QA in the direction of ordinate Q to coincide with the curve P2A. Upon adjusting the second setting screw in the direction of housing 1, the curve P2A is shifted parallel to the abscissa P about the value PA to coincide with the curve P2B which approaches the desired hyperbola P2.

In setting the screw 35 in the direction of housing 1, control edges 18 and 19 meet one another and dis-establish connection between the outlet opening 13 and the return conduit 21 thus causing a pressure increase on the larger adjustment piston 45 resulting in the adjustment of the vane pump 43 in the direction of a larger deliver. During the displacement of the larger adjustment piston 45, set of springs 39 and the cup spring 40 are pressure released so long until the control piston 3 resumes its starting position in which the communication of the outlet opening 13 of the bore 11 with the return conduit 21 is established. In other words, if the position of setting screw 35 is changed force exerted by spring 39 and cup spring 40 against the large adjustment piston 45 causes a change in the pump delivery while maintaining the same pressure. In shifting curve P1 toward the curve P2A, the inclination of both curves remains the same and it is only the power output of the pump which is changed.

By increasing the bias of spring 31 without changing the thrust of the spring set 39 and spring cap 40, the balance on the control piston 3 is established by increasing output pressure on the vane pump 43. Such a change of the bias of spring 31 against the control piston 3 corresponds to a shift of the curve P2A toward the curve P2B, the latter considerably approaching the desired ideal power output hyperbola P2. The delivery or output flow is measured in liters per minute and the output pressure is measured in bars.

It will be understood that each of the elements described above, or two or more together, may also find a useful application in other types of constructions differing from the types described above.

While the invention has been illustrated and described as embodied in a power output control device for a vane pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A power output control device for a pump of the type having a delivery adjuster including an adjustment member, a setting spring acting on the adjustment member, a control piston acted upon by the output flow from the pump and having means for controlling the delivery adjuster, governor spring means coupled to said piston for biasing the same against the output flow with a progressive force, additional biasing means acting on said control piston against said output delivery with a substantially constant force, means for adjusting said additional constant force including a rocking lever engaging said additional biasing means and said governor spring means, a first setting screw thrusting against said additional biasing means to adjust the biasing force thereof and a second setting screw thrusting againt said rocking lever to adjust the biasing force of said governor spring means.

2. A control device as defined in claim 1, wherein said rocking lever is a two arm lever pivotable about a pivot point, one arm of said rocking lever engaging said additional biasing means and the other arm engaging said governor spring means, and said second setting screw acting on said pivot point against said governor spring means.

3. A control device as defined in claim 2, wherein said pivot point includes two pivot pins and an upright guiding member for guiding said two-armed lever in direction parallel to the axis of said control piston.

4. A control device as defined in claim 3, including a housing body having an open top and a housing cover for closing said open top, said first and second setting screws being arranged in the housing cover and said guiding means for said two-armed lever including two juxtaposed pairs of upright guiding pins fixed in said housing body and slidably engaging said guiding pins of said two-armed lever.

5. A control device as defined in claim 2, wherein said additional biasing means includes a two piece spring retainer for accommodating a biasing spring, one piece of the spring retained being provided with coupling link for engaging said one arm of the lever and the other piece of the spring retainer being slidably guided in said housing cover and in engagement with said first setting screw.

* * * * *